United States Patent [19]

Thom et al.

[11] Patent Number: 4,873,016

[45] **Date of Patent: * Oct. 10, 1989**

[54] ENZYMATIC DETERGENT COMPOSITION

[75] Inventors: David Thom, Voorburg; Ton Swarthoff, Hellevoetsluis; Jan Maat, Monster, all of Netherlands

[73] Assignee: Lever Brothers Company, New York, N.Y.

[ * ] Notice: The portion of the term of this patent subsequent to Nov. 17, 2004 has been disclaimed.

[21] Appl. No.: 57,075

[22] Filed: Jun. 3, 1987

Related U.S. Application Data

[63] Continuation-in-part of Ser. No. 870,252, Jun. 3, 1986, Pat. No. 4,707,291.

[30] Foreign Application Priority Data

Jun. 11, 1985 [GB] United Kingdom ..... 8514707

[51] Int. Cl.[4] ..... C11D 3/386; C11D 3/395

[52] U.S. Cl. ..... 252/174.12; 252/95; 252/174.21; 252/186.1; 252/540; 252/559; 252/DIG. 12; 435/263

[58] Field of Search ..... 252/174.12, DIG. 12, 252/95, 99, 174.21, 540, 559, 186.1; 435/263, 264, 198, 19

[56] References Cited

U.S. PATENT DOCUMENTS

| | | | |
|---|---|---|---|
| 4,011,169 | 3/1977 | Diehl et al. | 252/95 |
| 4,381,247 | 4/1983 | Nakagawa et al. | 252/99 |
| 4,470,919 | 9/1984 | Goffinet et al. | 252/174.12 |

FOREIGN PATENT DOCUMENTS 0130064 1/1985 European Pat. Off. .

OTHER PUBLICATIONS

Lipase, The Enzyme for Detergent, Amano Pharmaceutical Co., Ltd., (Pre-Jun. 1985).

*Primary Examiner*—Paul R. Michl
*Assistant Examiner*—Hoa Van Le
*Attorney, Agent, or Firm*—Milton L. Honig

[57] ABSTRACT

The invention relates to a detergent composition comprising lipases. By inclusion of a certain, immunologically defined class of lipases in a detergent composition which comprises a mixture of an anionic and a nonionic detergent, an improved overall detergency is obtained. Typical suitable lipases are obtained from certain Pseudomonas and Chromobacter strains.

4 Claims, No Drawings

ENZYMATIC DETERGENT COMPOSITION

This is a continuation-in-part application of Ser. No. 870,252 filed June 3, 1986, now U.S. Pat. No. 4,707,291.

The present invention relates to an enzymatic detergent composition. More particularly it relates to an enzymatic detergent composition which contains a lipolytic enzyme.

Enzymatic detergent compositions are well known in the art. Enzymes of many types have been proposed for inclusion in detergent compositions, but the main attention has been focussed on proteases and amylases. Although lipases have been mentioned as possible enzymes for detergent compositions, there is relatively little prior art directly concerned with lipases for detergent compositions in general. Thus, our British Patent Specification No. 1,372,034 discloses the use of lipases produced by microorganisms of the Pseudomonas group, such as *Pseudomonas stutzeri* ATCC 19.154, in detergent compositions for soaking fabrics which contain specific nonionic detergent actives, optionally with a specific anionic detergent active. However, it was made clear that "the mere addition of lipoytic enzymes to any and all detergent compositions does not product, (as was shown) a satisfactory and acceptable detergent composition both regarding the enzyme activity and the cleaning efficiency. Various ingredients of detergent compositions have been found to exert a negative influence on lipolytic enzymes".

In British Patent Specification Nos. 1,442,418 and 1,442,419 a two-stage laundering process is described wherein a soaking step with a lipase-containing liquor is followed by a washing step with a detergent-containing wash liquor.

In specification No. 1,442,419 the "lipase-containing liquor" consisted of the claimed lipase(s) and a water soluble borax salt. Optional inclusion of conventional detergent surfactants or builders was mentioned but effectiveness in the presence of surfactants and builders was not demonstrated. In specification 1,442,418 the "lipase-containing liquor" consisted of the claimed lipase(s) plus borax and $Ca^{++}$ or $Mg^{++}$ ions. Surfactants were again mentioned but again no evidence relating to effectiveness in surfactant solutions was provided. Builders which bind $Ca^{++}$ and/or $Mg^{++}$ ions were specifically excluded in these pre-wash liquors. Overall, the wash process described by these specifications needed two separate formulated products; it was cumbersome and it would be of limited applicability in practice.

In a more recent article in Journal of Applied Biochemistry, 2 (1980), pages 218–229, Andree et al. report on their investigations of lipases as detergent components. They concluded that the two tested commercially available lipases (pancreatic lipase and Rhizopus lipase) were unstable in solutions of active systems containing mixtures of typical detergent anionic and nonionic surfactants. They deduced that the lipases were inactivated by the presence of the anionic detergents, the pancreatic lipase somewhat less so than the Rhizopus lipase. Andree et al. further concluded that the tested lipases can improve the washing efficiency of full nonionic detergent formulations but that this improvement can be matched by increasing the concentrations of nonionic active in detergent formulations.

A recently published European patent application, No. 0130064, describes the use of a lipase from *Fusarium oxysporum* as detergent additive. The detergent compositions exemplified in this patent application contain a nonionic and an anionic detergent, or consist solely of a nonionic detergent.

The above prior art therefore either teaches to use a specific lipase in detergent compositions, or to formulate specific detergent compositions and/or wash regimes for inclusion of lipases therein.

It is an object of the present invention to provide lipase-containing detergent compositions which have an improved overall detergency performance and which show significant detergency improvements by the inclusion of lipases therein.

We have now discovered that the inclusion of a certain class of lipases in a detergent composition which contains an anionic and a nonionic detergent-active material provides an improved overall detergency.

In contrast with the above prior art, complete, lipase-containing detergent compositions are provided by the present invention with which a normal washing process can be carried out, also at lower temperatures, whereby the benefits of the lipases are obtained without having to resort to special carefully selected detergent compositions or special washing or soaking steps of without having to treat the fabrics for long periods with the lipase-containing composition.

The class of lipases to be used according to the present invention embraces those lipases which show a positive immunological cross-reaction with the antibody of the lipase, produced by the microorganism *Pseudomonas fluorescens* IAM 1057. This lipase and a method for its purification have been described in Japanese Patent Application 53-20487, laid open to public inspection on Feb. 24, 1978. This lipase is available from Amano Pharmaceutical Co. Ltd, Nagoya, Japan, under the trade name Lipase P "Amano", hereinafter referred to as "Amano-P". The lipases of the present invention should show a positive immunological cross reaction with the Amano-P antibody, using the standard and well-known immunodiffusion procedure according to Ouchterlony (Acta. Med. Scan., 133, pages 76–79 (1950)).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant
day 4: antigen in complete Freund's adjuvant
day 32: antigen in incomplete Freund's adjuvant
day 60: booster of antigen in incomplete Freund's adjuvant The serum containing the required antibody is prepared by centrifugation of clotted blood, taken on day 67.

The titre of the anti-Amano-P-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All lipases showing a positive immunological cross reaction with the Amano-P antibody as hereabove described are lipases according to the present invention. Typical examples thereof are the Amano-P lipase, the lipase ex *Pseudomonas fragi* FERM P 1339 (available under the trade name Amano-B), lipase ex *Pseudomonas nitroreducens* var. *lipolyticum* FERM P 1338 (available under the trade name Amano-CES), lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from US Biochemical Corp., U.S.A. and Diosynth Co., The Netherlands, and lipases ex *Pseudomonas gladioli*.

Preferably, the lipases of the present invention should also show a positive immunological cross reaction with the antibody of one of the the following lipases: lipase ex *Chromobacter viscosum* var. *lipolyticum* NRRLB 3673, as sold by Toyo Jozo Co., Tagata, Japan, and lipase ex *Pseudomonas gladioli*.

Typical examples of such lipases showing such further cross reaction are Amano-P, Amano-B, Amano-CES, lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from US Biochemical Corp., U.S.A. and Diosynth Co., The Netherlands, and lipases ex *Pseudomonas gladioli*.

A Technical Leaflet printed by the Amano Pharmaceutical Company has reported that the Amano-B and Amano-CES lipases are useful in detergent systems including those that contain anionic and nonionic surfactants. The present invention is not intended to cover a detergent composition comprising anionic and nonionic detergent-active compounds where the lipase is produced by *Pseudomonas fragi* or *Pseudomonas nitroreducens* var. lipolyticum, whose commercial embodiments are found in Amano-B and Amano-CES, respectively. However, under circumstances where the formulation contains a bleaching agent in addition to the detergent-actives, the Amano-B and Amano-CES lipases are intended as operative species for purposes of this invention.

The lipases of the present invention are included in the detergent composition in such an amount that the final detergent composition has a lipolytic enzyme activity of from 100 to 0.005 LU/mg preferably 25 to 0.05 LU/mg of the composition.

A Lipase Unit (LU) is that amount of lipase which produces 1 μmol of titratable fatty acid per minute in a pH stat. under the following conditions: temperature 30° C.; pH=9.0; substrate is an emulsion of 3.3 wt. % of olive oil and 3.3% gum arabic, in the presence of 13 mmol $Ca^{2+}$ and 20 mmol NaCl in 5 mmol Tris-buffer.

Naturally, mixtures of the above lipases can be used. The lipases can be used in their impurified form, or in a purified form, e.g. purified with the aid of well-known adsorption methods, such as a phenylsepharose-packed column technique.

The detergent composition incorporating the lipases of the present invention contains as active detergent material a mixture of one or more nonionic synthetic detergent active materials and one or more anionic synthetic detergent-active materials. Both types of detergent-active materials are well known in the art, and suitable examples are fully described in Schwartz, Perry and Berch, Surface-Active Agents and Detergents, Vol. I (1949) and Vol. II (1958) and in Schick, Nonionic Surfactants, Vol. I (1967).

In general, the weight ratio of the nonionic to the anionic detergent varies from 12:1 to 1:12, preferably from 8:1 to 1:8, and particularly preferably from 4:1 to 1:4.

The amount of nonionic and anionic detergent-active material together in the detergent composition ranges from 1 to 30%, usually 2 to 20% and preferably 6 to 16% by weight.

Detergent materials of other types, such as soaps, cationic and zwitterionic detergents, may also be included.

The detergent composition may further more include the usual detergent ingredients in the usual amounts. They may be unbuilt or built, and may be of the zero-P type (i.e. not containing phosphorus-containing builders). Thus, the composition may contain from 1–45%, preferably from 5–30% by weight of one or more organic and/or inorganic builders. Typical examples of such builders are the alkali metal ortho-, pyro- and -tripolyphosphates, alkali metal carbonates, either alone or in admixture with calcite, alkali metal citrates, alkali metal nitrilotriacetates, carboxymethyloxysuccinates, zeolites, polyacetalcarboxylates and so on. Furthermore, it may contain from 1–35% of a bleaching agent or a bleaching system comprising a bleaching agent and an activator therefor. In this respect it has been surprisingly found that the lipases of the present invention often are significantly less affected by the bleaching agent or bleaching system in the composition than other lipases, not according to the invention.

The compositions may furthermore comprise lather boosters, foam depressors, anti-corrosion agents, soil-suspending agents, sequestering agents, anti-soil redeposition agents, perfumes, dyes, stabilising agents for the enzymes and bleaching agents and so on. They may also comprise enzymes other than lipases, such as proteases, amylases, oxidases and cellulases. In this respect it has surprisingly been found that, although the lipases of the present invention rapidly lose activity in the presence of proteases in clean model systems, under practical wash conditions in washing machines a substantial benefit is still delivered by the lipases in the presence of proteases.

The compositions of the present invention can be formulated in any desired form, such as powders, bars, pastes, liquids etc.

As said before, the compositions of the present invention show an improved overall detergency performance, particularly at lower temperatures. It is surprising that fully formulated detergent compositions incorporating the lipases of the present invention do show such an improved overall performance, when the prior art hitherto has indicated that lipases would only given some effect under particular conditions.

The invention will now further be illustrated by way of Examples.

EXAMPLE I

With the following particulate detergent composition, washing experiments were carried out with several lipases:

| | parts by weight |
|---|---|
| sodium dodecylbenzenesulphonate | 6.5 |
| $C_{14}$—$C_{15}$ primary alcohol, condensed with 11 moles of ethylene oxide | 2.0 |
| sodium stearate | 2.5 |
| sodium tripolyphosphate | 16.0 |
| trisodium orthophosphate | 5.0 |
| sodium silicate | 10.0 |
| soil-suspending agents | 1.0 |
| fluorescers | 0.2 |
| dyes | 0.001 |
| sodium sulphate | 24.0 |

-continued

| | parts by weight |
|---|---|
| water | 6.0 |

The lipases tested were Amano-P as described heretofore, furthermore SP 225, a lipase producible by *Mucor miehei* ex Novo Industri A/S and Esterase MM, a lipase producible by *Mucor miehei* ex Gist-Brocades.

The washing experiments were carried out under the following conditions:

washing process: 30 minutes at 30° C.

water hardness: 8° GH monitor: cotton test cloths soiled with a mixture containing inorganic pigments, protein, olive oil or palm oil, respectively and in the presence of cloth to give the desired cloth/liquor ratio.

lipase concentration: 15 LU/ml cloth/liquor ratio: 1:6.

dosage of composition: 6 g/l

The number of soil/wash cycles was 4, and after the fourth wash the reflectance of the test cloths and the residual percentage of fatty material on the test cloths were determined. The reflectance was measured in a Reflectometer at 460 nm with a UV filter in the light pathway and the fatty matter by extracting the dried test cloths with petroleum ether, distilling off the solvent and weighing the resulting fatty matter.

The following results were obtained:

| lipase | $R^*_{460}$ | % FM palm oil | % FM olive oil |
|---|---|---|---|
| — | 63.9 | 12.5 ± 0.1 | 10.0 ± 0.6 |
| Amano-P | 70.5 | 7.2 ± 0.6 | 6.3 ± 0.6 |
| SP 225 | 65.0 | 11.3 ± 0.9 | 9.8 ± 0.1 |
| Esterase MM | 67.3 | 10.1 ± 0.3 | 8.7 ± 0.8 |

These results show that the lipase of the present invention (Amano-P) is superior to the other two prior art lipases.

EXAMPLE II

Replacing Amano-P by Diosynth as heretofore described in Example I gave similar results.

EXAMPLE III

The lipase stability of various lipases in a bleach containing detergent composition (5 g/l) containing 3% TAED, 8% sodiumperboratemonohydrate and 0.3% Dequest® was compared at 30° C. in water of 22° GH. The balance of the formulation was equal to the one as described in Example VIII; no Savinase® or other proteolytic enzyme was present.

| Lipase | Residual activity (% of input) 10 min. | 30 min. | halftime (min.) |
|---|---|---|---|
| Amano-P | 95 | 99 | * |
| C. viscosum NRRLB 3673 | 84 | 73 | * |
| Amano CE (ex *Humicola lanuginosa*) | 100 | 100 | * |
| Amano AP (ex *Aspergillus niger*) | 83 | 48 | 27 |
| Mucor Miehei lipase | 61 | 13 | 27 |
| Fusarium oxysporum lipase | 14 | 0 | 3 |
| Esterase MM (ex *Mucor mihei*) | 38 | 10 | 7 |
| Lipase PL ex Meito Sangyo, Japan (ex *Alcaligenes species*) | 19 | 0 | 3 |
| MY 30.000 ex Meito Sangyo, Japan (ex *Candida cylindraceae*) | 5 | 0 | 3 |

-continued

EXAMPLE IV

The stability of the lipases was tested in clean wash liquors, using the detergent formulation of Example V with and without the bleaching system and/or proteolytic enzymes. The water hardness was 22° GH.

The following results were obtained:

| Clean systems | residual activity after 10 min. | 30 min. |
|---|---|---|
| Amano-P | (%) | (%) |
| Base powder (without bleach and protease | 100 | 98 |
| Base powder + TAED/perborate | 95 | 95 |
| Base powder + Savinase (protease) | 20 | 10 |
| Base powder + Alcalase (protease) | 10 | — |
| Base powder + Esperase (protease) | 10 | — |
| Diosynth | | |
| Base detergent powder + TAED/perborate | 98 | 96 |
| Base detergent powder + TAED/perborate + Savinase | 50 | 30 |
| Toyo Jozo | | |
| Base detergent powder + TAED/perborate | 93 | 93 |
| Base detergent powder + TAED/perborate + Savinase | 55 | 30 |

The stability of lipases of the invention in bleach containing detergent formulations is further demonstrated. In these clean detergent solutions the sensitivity of the lipases to proteolytic attack is also shown.

EXAMPLE V

The performance in washing machines of Amano P in the presence of strong bleach(6/12; TAED/perborate) and high levels of a proteolytic enzyme(Savinase; 30GU/ml) was determined. The formulation of Example I was used at a water hardness of 8 GH and using the wash conditions given in Example I.

Following results were obtained after the fourth wash:

| Cotton | olive oil $R^*_{460}$ | % FM | palm oil $R^*_{460}$ | % FM |
|---|---|---|---|---|
| base powder only | 67.7 | 8.8 | 68.5 | 9.5 |
| base powder + lipase | 75.8 | 6.2 | 76.8 | 5.5 |
| base p. + Savinase + bleach | 71.6 | 8.8 | 74.3 | 8.2 |
| base p. + Sav. + bleach + lipase | 76.2 | 7.4 | 76.2 | 7.1 |

These results showed that

Savinase (bleach) have a large effect on $R^*_{460}$ but no or little effect on %FM In contrast to the sensitivity to Savinase in clean detergent solutions shown in Example IV, the lipase is compatible with Savinase/bleach (30GU/ml)/(6/12 TAED/perforatemonohydrate) in these realistic practical wash trials although some inhibition occurred.

EXAMPLE VI

In the same manner as described in Example I, the lipase Amano-P was compared with a lipase producible by *Fusarium oxysporum* according to EP 0130064. The test cloths were cotton and polyester fabrics, the soiling contained a mixture of palm oil, protein and inorganic pigment and the water hardness was 8° and 22° GH.

The following results were obtained:

| | | 8° GH | | 22° GH | |
|---|---|---|---|---|---|
| | lipase | $R^*_{460}$ | % FM | $R^*_{460}$ | % FM |
| cotton | — | 60.4 | 11.2 | 55.8 | 15.9 |
| | Amano-P | 62.6 | 8.1 | 58.7 | 11.8 |
| | lipase ex Fusarium | 63.8 | 9.9 | 61.4 | 13.7 |
| | lipase | $R^*_{460}$ | % FM | $R^*_{460}$ | % FM |
| polyester | — | 67.9 | 7.4 | 64.9 | 8.2 |
| | Amano-P | 72.6 | 4.5 | 68.1 | 5.5 |
| | lipase ex Fusarium | 70.2 | 7.3 | 70.2 | 7.2 |

The lipase according to EP 0130064 had a lipolytic activity of 90 LU/mg,, but also showed a proteolytic activity of 120 GU/mg. Amano P does not show any detectable proteolytic activity. Although the effects of lipase ex Fusarium on % FM are negligible/small, the effects on $R^*_{460}$ are quite marked. This however, is easily explainable by the proteolytic activity in this lipase sample if a comparison with Example V (powder+Savinase versus powder+lipase) is made.

EXAMPLE VII

Comparing in the manner as described in Example I the lipase Amano-P with a lipase of the same manufacturer, not according to the invention, Amano CE, and with two other lipases according to the invention, Amano B and Amano CES gave the following results:

| | cotton | |
|---|---|---|
| lipase | $R^*_{460}$ | % FM |
| — | 61.9 | 9.8 |
| Amano-P | 66.0 | 6.8 |
| Amano CE | 65.3 | 8.7 |
| Amano B | 65.6 | 6.7 |
| Amano CES | 65.2 | 6.9 |

The Amano CE lipase had an activity of 17 LU/mg, but also showed a proteolytic activity of 16 GU/mg. Amano-P, Amano-B and Amano CES had comparable LU/mg activities, but do not show any detectable proteolytic activity. Again the good result on $R^*_{460}$ but not on %FM of Amano CE are explained by its contaminated proteolytic activity.

EXAMPLE VIII

With the following particulate detergent composition, further washing experiments were carried out to show compatibility with bleach and proteolytic enzymes during the wash process.

| | parts by weight |
|---|---|
| sodium dodecylbenzenesulphonate | 8.5 |
| $C_{12}$–$C_{15}$ primary alcohol, condensed with 7 moles of ethylene oxide | 4.0 |

-continued

| | parts by weight |
|---|---|
| sodium-hardened rapeseed oil soap | 1.5 |
| sodium triphosphate | 33.0 |
| sodium carbonate | 5.0 |
| sodium silicate | 6.0 |
| sodium sulphate | 20.0 |
| water | 9.0 |
| fluorescers, soil-suspending agents, dyes, perfumes | minor amount |
| sodium perborate | 12.0 |
| tetraacetyl ethylene diamine (TAED) (granules) | 2.0 |
| proteolytic enzyme (Savinase ex Novo) | 0.4 |

The washing experiments were carried out under the following conditions:

washing machine with a load of 3.5 kg dirty laundry washing process: 30 minutes at 30° C.

water hardness: 8 and 22° GH lipase concentrations: 15 LU/ml dosage of compositions 3.5 g/l.

The following results were obtained after the fourth wash:

| | | 8° GH | | 22° GH | |
|---|---|---|---|---|---|
| | lipase | $R^*_{460}$ | % FM | $R^*_{460}$ | % FM |
| cotton | — | 73 | 12.1 | 70 | 15.9 |
| | Amano-P | 79 | 6.7 | 76.5 | 7.5 |
| | | 8° GH | | 22° GH | |
| | lipase | $R^*_{460}$ | % FM | $R^*_{460}$ | % FM |
| polyester | — | 67.5 | 9.9 | 70 | 10.7 |
| | Amano-P | 76.5 | 8.1 | 77 | 9.8 |

EXAMPLE IX

A similar experiment as in Example VIII was done using lipase according to the invention with different resistance against proteolytic enzymes as shown in Example IV.

Lipase concentration was 5 LU/ml.

Textile used was cotton.

| | Lipase | |
|---|---|---|
| | $R^*_{460}$ | % FM |
| — | 67.8 | 15.5 |
| Amano-P | 71.6 | 11.2 |
| C. viscosum ex Toyo Jozo | 74.2 | 9.5 |
| C. viscosum ex Diosynth | 72.9 | 10.3 |

Residual activities in the wash liquor after the 30 minutes wash process:

Amano-P: 36%

Toyo Jozo: 55%

Diosynth: 60%

Detailed comparison with Example IV shows that in the realistic, practical wash conditions used in this Example lipases of the invention are substantially less sensitive to attack by proteases such as Savinase used in detergent products.

EXAMPLE X

The test of Example 1 was repeated, but using 4 g/l of the detergent composition and using lipases in an amount of 1 LU/ml. The following results were obtained:

| Lipase | IgG reaction | R*460 palm oil | R*460 olive oil | % FM palm oil | % FM olive oil |
|---|---|---|---|---|---|
| — | — | 61.3 | 59.8 | 13.7 | 13.7 |
| Amano-P | + | 72.1 | 71.2 | 7.4 | 7.4 |
| Toyo Jozo | + | 72.0 | 70.8 | 7.2 | 8.0 |
| Diosynth | + | 73.0 | 71.5 | 7.1 | 7.8 |
| Amano AP 6 (ex *Aspergillus niger*) | — | 63.2 | 63.5 | 12.9 | 11.9 |
| Lipase MY (ex *Candida cylindraceae*) | — | 63.8 | 62.7 | 12.3 | 11.8 |
| Lipase ex *Candida cylindraceae* | — | 63.5 | 63.6 | 12.8 | 11.1 |
| Lipase ex *Fusarium oxysporum* | — | 64.8 | 61.2 | 12.0 | 14.1 |
| Lipase ex *Mucor mihei* | — | 66.0 | 65.3 | 11.3 | 11.1 |
| Esterase MM (ex *Mucor mihei*) | — | 67.4 | 66.6 | 10.0 | 9.8 |
| Amano CE (ex *Humicola lanuginosa*) | — | 68.9 | 66.6 | 9.3 | 10.4 |

EXAMPLE XI

In the same manner as in Example I, washing experiments were carried out, using either 5 g/l of the detergent composition of Example VIII (water hardness 22° GH) or 4 g/l of the detergent composition of Example I (water hardness 8° GH). The lipases were used at 1 and 3 LU/ml. The test cloths were either polyester/cotton (P/C) mixed fabrics, or pre-washed cotton (PWC).

The following results were obtained.

with the composition of Example VIII:

| Lipase | R*460 P/C | R*460 PWC | % FM P/C | % FM PWC |
|---|---|---|---|---|
| 0 | 66.7 | 71.5 | 16.8 | 7.4 |
| 1 LU Toyo Jozo | 78.6 | 73.0 | 7.6 | 6.8 |
| 3 LU Toyo Jozo | 80.1 | 74.3 | 6.9 | 5.5 |
| 1 LU lipase ex *Pseudomonas gladioli* | 80.0 | 73.9 | 7.5 | 5.8 |
| 3 LU lipase ex *Pseudomonas gladioli* | 80.8 | 74.9 | 6.8 | 5.1 |
| with the composition of Example I: | | | | |
| 0 | 73.7 | 67.8 | 10.6 | 9.0 |
| 1 LU Toyo Jozo | 78.8 | 72.7 | 6.9 | 5.1 |
| 3 LU Toyo Jozo | 79.7 | 73.7 | 7.1 | 4.7 |
| 1 LU lipase ex *Pseudomonas gladioli* | 79.9 | 73.3 | 6.6 | 4.9 |
| 3 LU lipase ex *Pseudomonas gladioli* | 80.7 | 74.7 | 7.3 | 4.6 |

EXAMPLE XII

Repeating Example I, using the detergent composition of Example I at 4 g/l in water of 8° GH, or the detergent composition of Example VIII at 5 g/l in water of 22° GH, at various temperatures gave the following results:

| | Toyo Jozo lipase (LU/ml) | Temperature (°C.) | R*460 palm oil | R*460 olive oil | % FM palm oil | % FM olive oil |
|---|---|---|---|---|---|---|
| Composition of Example I | 0 | 30 | 64.3 | 61.4 | 14.5 | 16.0 |
| " | 3 | 30 | 74.2 | 72.6 | 7.4 | 7.6 |
| " | 0 | 40 | 68.2 | 64.8 | 12.5 | 13.7 |
| " | 3 | 40 | 75.9 | 74.2 | 6.5 | 6.9 |
| " | 0 | 50 | 68.9 | 68.3 | 12.3 | 11.8 |
| " | 3 | 50 | 76.4 | 75.1 | 6.1 | 6.4 |

-continued

| | Toyo Jozo lipase (LU/ml) | Temperature (°C.) | R*460 palm oil | R*460 olive oil | % FM palm oil | % FM olive oil |
|---|---|---|---|---|---|---|
| Composition of Example VIII | 0 | 30 | 73.9 | 74.7 | 8.4 | 7.9 |
| " | 3 | 30 | 75.4 | 76.1 | 7.6 | 7.0 |
| " | 0 | 40 | 74.8 | 75.0 | 7.5 | 7.8 |
| " | 3 | 40 | 76.1 | 76.3 | 6.9 | 7.1 |
| " | 0 | 50 | 75.3 | 75.4 | 7.5 | 7.7 |
| " | 3 | 50 | 76.9 | 76.8 | 6.1 | 7.6 |

EXAMPLE XIII

In the manner as described in Example I, the following detergent compositions were tested.

A:
- 9% anionic detergent
- 1% nonionic detergent
- 21.5% sodium tripolyphosphate
- 7% sodium perborate
- 0.6% Savinase (a proteolytic enzyme)
- balance sodium sulphate + minor ingredients B:
- 9% anionic detergent
- 4% nonionic detergent
- 28% zeolite
- 4.5% nitrilotriacetate
- 5.5% sodium perborate
- 3.5% tetraacetylethylenediamine
- 0.5% Savinase
- balance sodium sulphate + minor ingredients C:
- 5% anionic detergent
- 4% nonionic detergent
- 1% soap
- 30% zeolite
- 3.% copolymer of acrylic acid with maleic anhydride
- 7.5% sodium perborate
- 3% tetraacetylethylenediamine
- balance sodium sulphate + minor ingredients D:
- 8% anionic synthetic detergent
- 4% nonionic synthetic detergent
- 4% soap
- 35.% sodium carbonate
- 20% powdered calcite
- 6% sodium perborate
- 2% tetraacetylethylenediamine
- 0.5% Savinase
- balance sodium sulphate + minor ingredients The following results were obtained:

| Composition | lipase (Toyo Jozo) LU/ml | R*460 palm oil | % FM palm oil |
|---|---|---|---|
| A | 0 | 68.0 | 11.3 |
| | 3 | 71.5 | 8.7 |
| | 15 | 75.2 | 7.1 |
| B | 0 | 70.7 | 9.6 |
| | 3 | 73.4 | 8.9 |
| | 15 | 75.1 | 7.9 |
| C | 0 | 73.5 | 8.3 |
| | 3 | 75.0 | 7.6 |
| | 15 | 77.3 | 6.1 |
| D | 0 | 63.1 | 16.1 |
| | 3 | 71.9 | 10.6 |
| | 15 | 75.0 | 8.0 |

We claim:

1. A detergent composition comprising from 1 to 30% of a mixture of an anionic and a nonionic detergent-active compound in a weight ratio from 12:1 to 1:12, from 1 to 35% of a bleaching agent, and a lypolytic enzyme, wherein the enzyme shows a positive immunological cross-reaction with the antibody of the lipase produced by the microorganism *Pseudomonas fluorescens* IAM 1057, said composition containing the enzyme in such an amount that the final composition has a lipolytic activity of from 0.005 to 100 Lipase Units per milligram.

2. A composition according to claim 1, wherein the enzyme additionally shows a positive immunological cross-reaction with the antibody of the lipase produced by the microoragnism *Chromobacter viscosum* var. *lipolyticum* NRRLB 3673 or *Pseudomonas gladioli.*

3. A composition according to claim 1, wherein the positive immunological cross-reaction showing enzyme is a lipase produced by strains of the Pseudomonas and the Chromobacter genus.

4. A composition according to claim 1, further containing a proteolytic enzyme in an amount sufficient to provide a proteolytic activity of from 0.005 to 0.1 Anson Units per gram of composition.

* * * * *